US007817064B2

(12) United States Patent
Nishida

(10) Patent No.: US 7,817,064 B2
(45) Date of Patent: Oct. 19, 2010

(54) ROAD-CONDITION INFORMING APPARATUS AND ROAD-CONDITION INFORMING METHOD

(75) Inventor: Shinsuke Nishida, Tokyo (JP)

(73) Assignee: Fourie, Tokyo (JP)

( * ) Notice: Subject to any disclaimer, the term of this patent is extended or adjusted under 35 U.S.C. 154(b) by 536 days.

(21) Appl. No.: 11/632,490

(22) PCT Filed: Jul. 16, 2004

(86) PCT No.: PCT/JP2004/010569

§ 371 (c)(1),
(2), (4) Date: Jan. 16, 2007

(87) PCT Pub. No.: WO2006/008825

PCT Pub. Date: Jan. 26, 2006

(65) Prior Publication Data

US 2007/0252725 A1 Nov. 1, 2007

(51) Int. Cl.
*G08G 1/09* (2006.01)

(52) U.S. Cl. ..... 340/905; 340/539.22; 340/934

(58) Field of Classification Search ..... 340/905, 340/539.22, 539.26, 601, 933, 934, 935, 340/938; 324/337, 344
See application file for complete search history.

(56) References Cited

U.S. PATENT DOCUMENTS

| | | | | |
|---|---|---|---|---|
| 4,100,529 | A * | 7/1978 | Evans | 340/901 |
| 5,280,632 | A * | 1/1994 | Jung-Gon | 455/70 |
| 5,892,461 | A * | 4/1999 | Dokko | 340/907 |
| 6,064,318 | A | 5/2000 | Kirchner, III et al. | |
| 6,092,005 | A * | 7/2000 | Okada | 701/1 |
| 6,441,748 | B1 * | 8/2002 | Takagi et al. | 340/901 |
| 6,825,778 | B2 * | 11/2004 | Bergan et al. | 340/936 |
| 6,900,740 | B2 * | 5/2005 | Bloomquist et al. | 340/905 |
| 6,922,136 | B2 * | 7/2005 | Komada et al. | 340/425.5 |
| 2006/0087453 | A1 | 4/2006 | Iwane | |
| 2006/0119489 | A1 | 6/2006 | Shinada et al. | |
| 2006/0261975 | A1 * | 11/2006 | Fridthjof | 340/905 |

FOREIGN PATENT DOCUMENTS

| | | | |
|---|---|---|---|
| FR | 2670018 | A1 | 6/1992 |
| GB | 2269694 | A | 2/1994 |
| GB | 2358506 | | 7/2001 |
| JP | 60-83198 | A | 5/1985 |
| JP | 61-147496 | U | 9/1986 |
| JP | 8-263789 | A | 10/1996 |
| JP | 2000-48296 | A | 2/2000 |
| JP | 2003-288673 | A | 10/2003 |
| JP | 2004-13401 | A | 1/2004 |
| JP | 2004-46875 | A | 2/2004 |
| JP | 2004-132737 | A | 4/2004 |
| WO | 0143104 | A1 | 6/2001 |

OTHER PUBLICATIONS

European Search Report, dated Aug. 14, 2008.

* cited by examiner

*Primary Examiner*—Toan N Pham
(74) *Attorney, Agent, or Firm*—Sughrue Mion, PLLC

(57) ABSTRACT

A detecting unit that is provided at a detection position on a road detects a road condition near the detection position. A light emitting unit that is provided at the detection position emits a light. A control unit controls a light emission of the light emitting unit based on detected road condition.

10 Claims, 6 Drawing Sheets

ROAD-CONDITION INFORMING APPARATUS AND ROAD-CONDITION INFORMING METHOD

TECHNICAL FIELD

The present invention relates to a road-condition informing apparatus and a road-condition informing method, and more particularly, to a road-condition informing apparatus and a road-condition informing method with a capability of informing road conditions in real time at a low cost.

BACKGROUND ART

Recently, there have been many traffic accidents on freeways and the like in which a vehicle crashes into another vehicle positioned at the end of traffic congestion, and various countermeasures have been taken. For instance, according to an example of methods for providing drivers of vehicles with information about traffic congestion, which is an example of road conditions, sensors for monitoring traffic congestion and information display boards are provided at a number of places on freeways. An integrated control apparatus judges whether there is traffic congestion based on detection results from the sensors, so that congestion information such as "Congestion Ahead" is displayed on the information display boards.

As a result, the drivers of the vehicles who see the congestion information on the information display boards pay attention and address the situation by, for example, reducing the speed of the vehicle, as necessary.

In addition, according to a conventional technique, a system that provides drivers of vehicles with information about traffic congestion has been put to practical use. In this system, an integrated control apparatus as described above transmits the information about traffic congestion to navigation apparatuses installed on the vehicles via optical/electric wave beacons disposed on the roads or via Frequency Modulation (FM) multiplex broadcasting (see Patent Document 1).

Patent Document 1: Japanese Patent Application Laid-open No. 2004-132737

According to the conventional technique, the integrated control apparatus exercises integrated control by collecting the detection results from the sensors and providing the information about the traffic congestion. Thus, it is necessary to maintain a network for connecting various units to the integrated control apparatus. Consequently, a problem arises where the cost is high.

Also, according to the conventional technique, after the detection results are collected in the integrated control apparatus first, a judgment is made on the condition of traffic congestion, before the information about the road conditions (i.e. the traffic congestion) is displayed on the information display boards. Thus, the processing performed by the integrated control apparatus takes time. Consequently, another problem arises where it is not possible to give information of the road conditions in a real-time manner.

In view of the problems explained above, it is an object of the present invention to provide a road-condition informing apparatus and a road-condition informing method with a capability of informing road conditions in real time at a low cost.

DISCLOSURE OF INVENTION

To achieve the above object, a road-condition informing apparatus according to one aspect of the present invention includes a detecting unit configured to be provided at one of a plurality of detection positions on a road, and to detect a road condition near the detection position; a light emitting unit configured to be provided at the one of the detection positions, and to emit a light; and a control unit configured to control a light emission of the light emitting unit, based on a result of detection by the detecting unit, and to inform the road condition to a driver of a vehicle driving on the road.

A road-condition informing method according to another aspect of the present invention includes a detection step of detecting a road condition near one of a plurality of detection positions on a road; and a controlling step including controlling, based on a result of detection at the detection step, a light emission of a light emitting unit that is provided at the one of the detection positions and emits a light, and informing the road condition to a driver of a vehicle driving on the road.

According to the present invention, the light emitting state of the light emitting unit is controlled based on the result of the detection related to the road condition near one of the plurality of detection positions on the road, so that the driver of a vehicle driving on the road is informed of the road condition. Thus, it is not necessary to use an integrated control apparatus as an intermediary, unlike in the system according to the conventional technique. Consequently, an effect is achieved where it is possible to give information of the road conditions at low cost and in a real-time manner.

BEST MODE(S) FOR CARRYING OUT THE INVENTION

Figure 1:
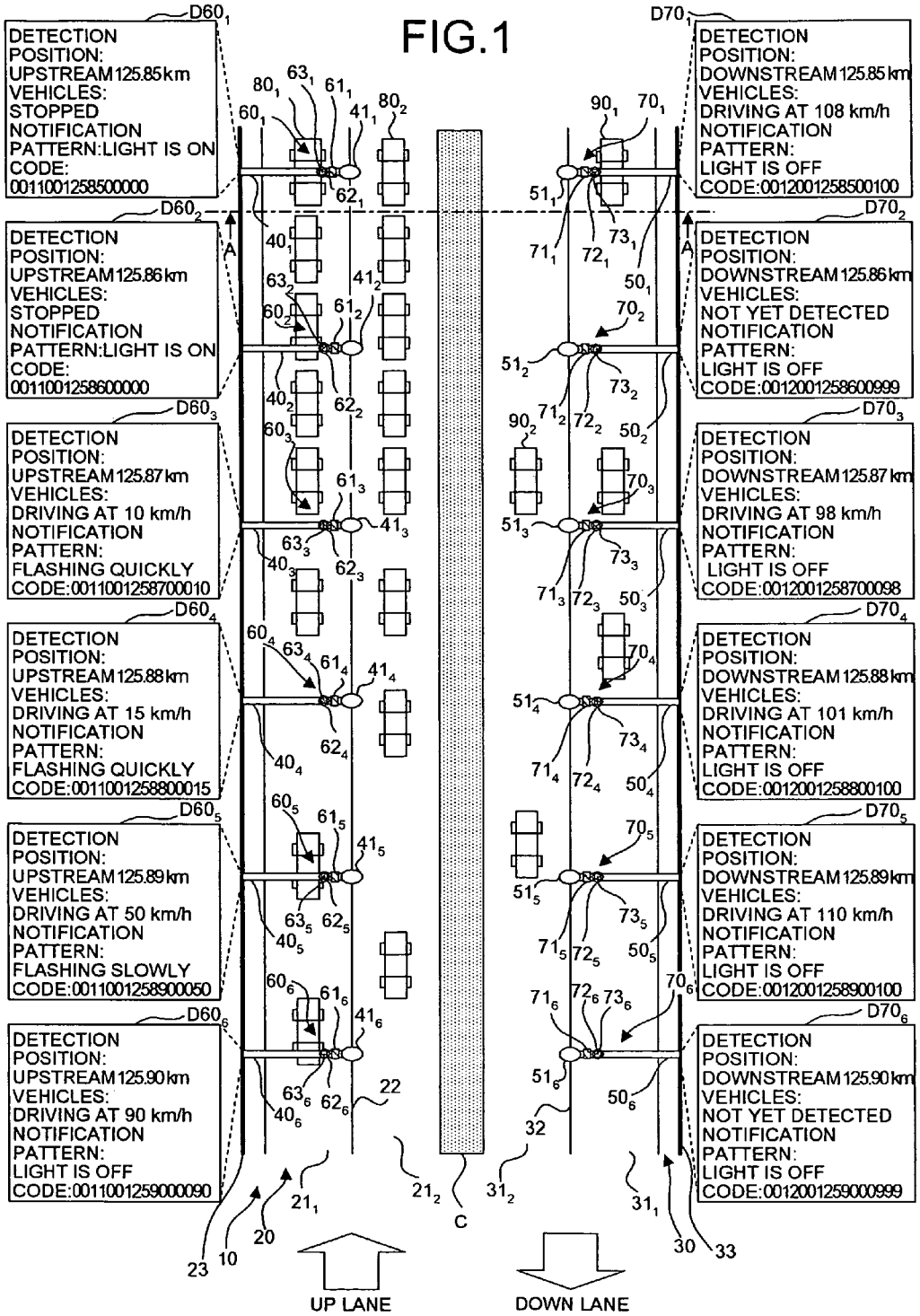
FIG. 1 is a plan view for explaining installation of road-condition informing apparatuses $\mathbf{60}_1$ to $\mathbf{60}_6$ and road-condition informing apparatuses $\mathbf{70}_1$ to $\mathbf{70}_6$ according to an embodiment of the present invention.
Figure 2:
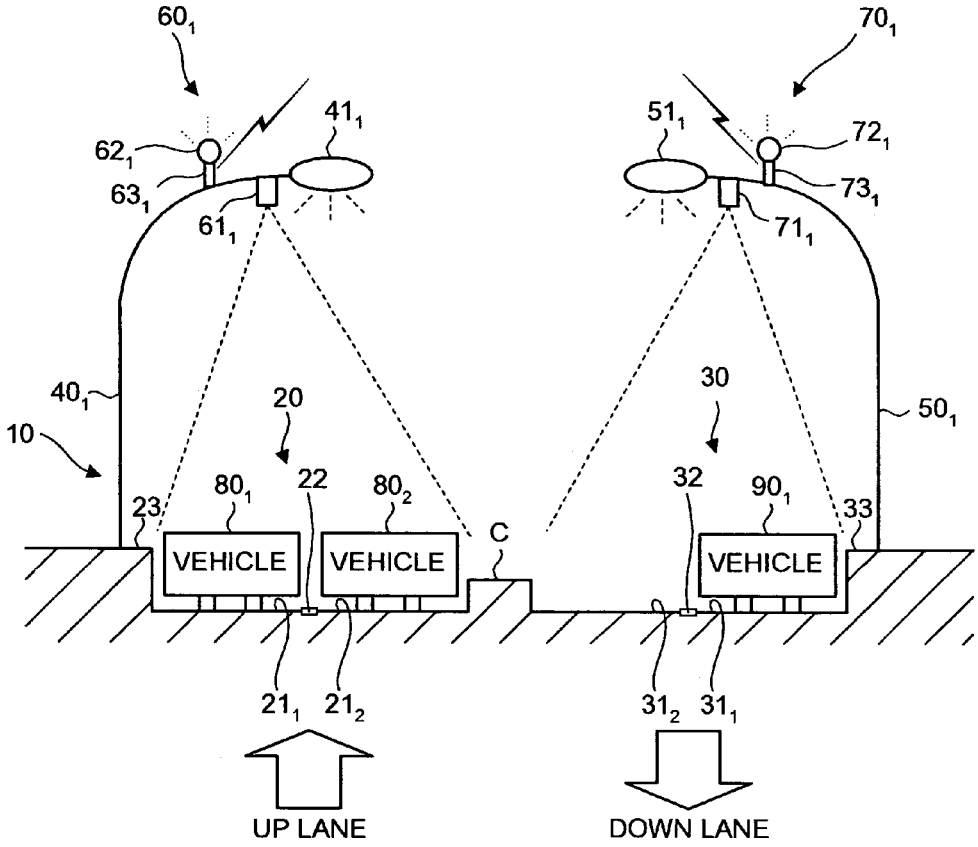
FIG. 2 is a cross-sectional view at the line A-A shown in FIG. 1.

Exemplary embodiments of the present invention will be explained in detail below with reference to the accompanying drawings. FIG. 1 is a plan view for explaining installation of road-condition informing apparatuses according to an embodiment of the present invention. FIG. 2 is a cross-sectional view at the line A-A shown in FIG. 1. In these figures, a road-condition informing system for informing drivers of vehicles of road conditions (e.g. traffic congestion conditions) on a freeway 10 is shown.

As shown in FIG. 1, the freeway 10 has an up-lane road 20 and a down-lane road 30 on either side of a median strip C. The up-lane road 20 is made up of, for example, two lanes that are namely a first up lane $\mathbf{21}_1$ and a second up lane $\mathbf{21}_2$. On the up-lane road 20, a plurality of vehicles $\mathbf{80}_1$, $\mathbf{80}_2$, and so on are driving under a road condition as shown in the figure (i.e. in traffic congestion). More specifically, the up-lane road 20 is more congested as one drives along the up lane direction (i.e. the top of the drawing).

On a shoulder 23 of the up-lane road, a plurality of streetlight poles $\mathbf{40}_1$ to $\mathbf{40}_6$ are disposed with predetermined intervals therebetween (for example, 10 meters). The tip portion of each of the streetlight poles $\mathbf{40}_1$ to $\mathbf{40}_6$ is curved toward the median strip C side (see FIG. 2). In addition, streetlights $\mathbf{41}_1$ to $\mathbf{41}_6$ for illuminating the up-lane road 20 are attached to the tip portions of the streetlight poles $\mathbf{40}_1$ to $\mathbf{40}_6$, respectively.

On the other hand, like the up-lane road 20, the down-lane road 30 is also made up of two lanes that are namely a first down lane $\mathbf{31}_1$ and a second up lane $\mathbf{31}_2$. On the down-lane road 30, a plurality of vehicles $\mathbf{90}_1$, $\mathbf{90}_2$, and so on are driving under a road condition as shown in the figure (i.e. in no traffic congestion). More specifically, on the down-lane road 30, the vehicles $\mathbf{90}_1$, $\mathbf{90}_2$, and so on are driving smoothly.

On a shoulder 33 of the down-lane road, like on the shoulder 23 of the up-lane road, a plurality of streetlight poles $\mathbf{50}_1$ to $\mathbf{50}_6$ are disposed with predetermined intervals therebetween. The tip portion of each of the streetlight poles $\mathbf{50}_1$ to $\mathbf{50}_6$ is curved toward the median strip C side (see FIG. 2). In addition, streetlights $\mathbf{51}_1$ to $\mathbf{51}_6$ for illuminating the down-lane road 30 are attached to the tip portions of the streetlight poles $\mathbf{50}_1$ to $\mathbf{50}_6$, respectively.

On the up-lane road 20 side, the road-condition informing apparatuses $\mathbf{60}_1$ to $\mathbf{60}_6$ are installed on the tip portions of the streetlight poles $\mathbf{40}_1$ to $\mathbf{40}_6$, respectively. After detecting the condition of the up-lane road 20 (for example, whether there is traffic congestion and the degree of the traffic congestion), each of the road-condition informing apparatuses $\mathbf{60}_1$ to $\mathbf{60}_6$ informs drivers of vehicles of the condition via light or wireless communication.

Figure 3:
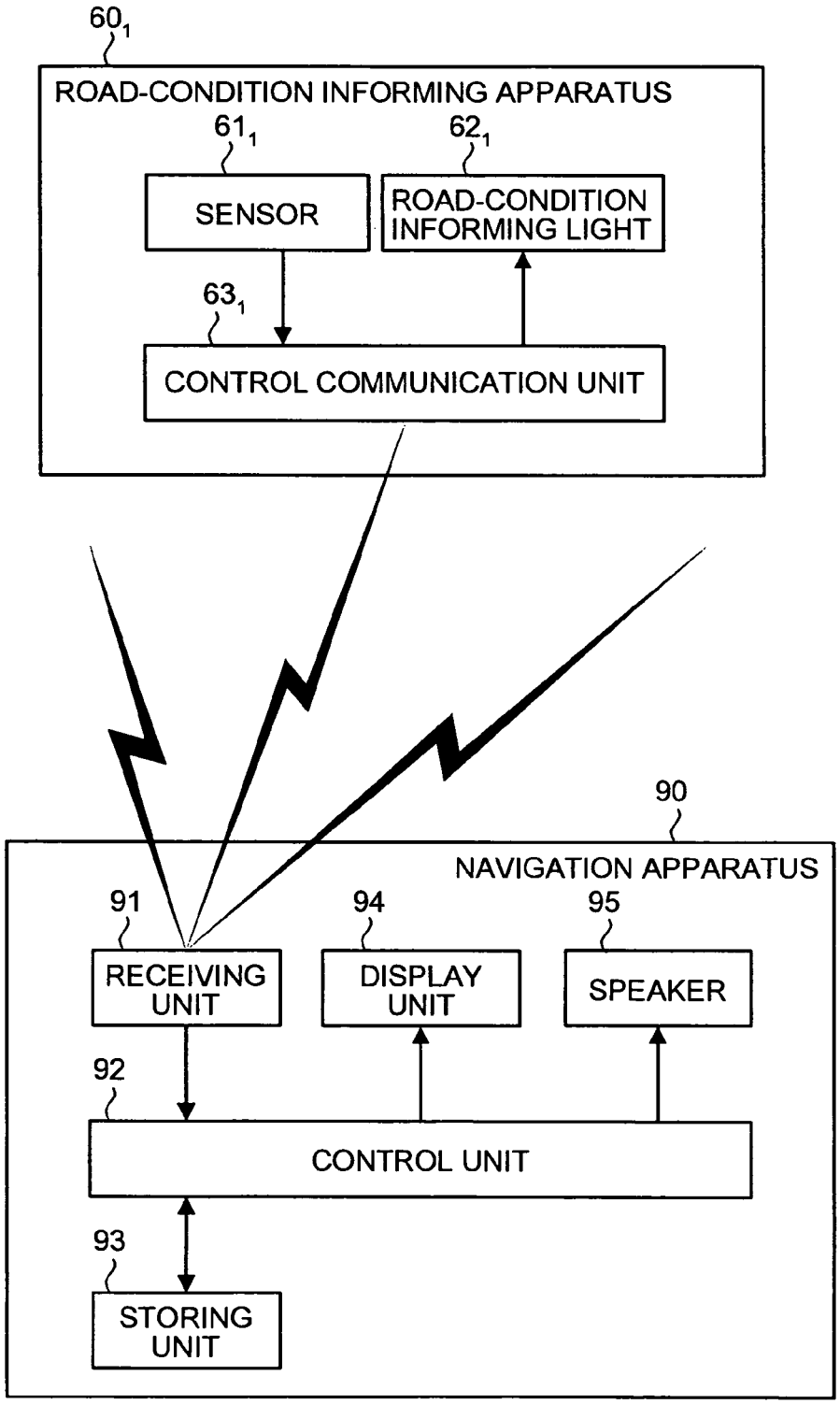
FIG. 3 is a block diagram of the road-condition informing apparatus $\mathbf{60}_1$ shown in FIG. 1 and a navigation apparatus 90 installed on a vehicle.

As shown in FIG. 2 and FIG. 3, the road-condition informing apparatus $\mathbf{60}_1$ includes a sensor $\mathbf{61}_1$, a road-condition informing light $\mathbf{62}_1$, and a control communication unit $\mathbf{63}_1$. As shown in FIG. 2, the sensor $\mathbf{61}_1$ is one of an ultrasound sensor, an infrared ray sensor, a wireless beacon, a metal sensor, a camera, and the like that is attached to the tip portion of the streetlight pole $\mathbf{40}_1$ and is a sensor that detects the road condition (e.g. whether there is any vehicle and the speed of the vehicle) on the up-lane road 20 that is positioned immediately underneath. The detection area of the sensor $\mathbf{61}_1$ is a predetermined area (of the up-lane road 20) positioned immediately underneath.

The road-condition informing light $\mathbf{62}_1$ is a colored lamp (for example, an orange lamp) that is attached to the tip portion of the streetlight pole $\mathbf{40}_1$ and has a function of informing the drivers of the vehicles of the road condition (whether there is traffic congestion and the degree of the traffic congestion) via light (turning on the light, turning off the light, flashing the light, etc.).

Based on the detection result from the sensor $\mathbf{61}_1$, the control communication unit $\mathbf{63}_1$ controls and drives the road-condition informing light $\mathbf{62}_1$ according to the road condition. The control communication unit $\mathbf{63}_1$ also transmits road-condition information $D\mathbf{60}_1$, as shown in FIG. 1, to each of the navigation apparatuses (e.g. the navigation apparatus 90 shown in FIG. 3) installed on the vehicles, at intervals having a predetermined length.

The road-condition information $D\mathbf{60}_1$ includes information regarding "detection position", "vehicles", "information pattern", and "code". The road-condition information $D\mathbf{60}_1$ is information that corresponds to the road condition detected by the sensor $\mathbf{61}_1$. The "detection position" is information that corresponds to the position at which the road condition has been detected. More specifically, the "detection position" corresponds to a distance marker called a "kilometer post" (expressing a distance [km] from a reference point) at which the streetlight pole $\mathbf{40}_1$ is positioned on the freeway 10 and is expressed by a combination of one of "up lane" and "down lane" ("up lane" in the example in the figure) and the distance, that is, 125.85 kilometers.

The "vehicles" is information expressing whether there is any vehicle and the speed of the vehicle. The "information pattern" is a lighting pattern used by the road-condition informing light $\mathbf{62}_1$ in correspondence with the detection result of the road condition. There are four lighting patterns such as the light is on, flashing slowly, flashing quickly, and off.

The information pattern with the light on means that a detection result of the road condition shows that the vehicles are stopped (the driving-speed=0 km/h) and informs that there is a high degree of traffic congestion. The information pattern with the light flashing quickly corresponds to a detection result of the road condition having a driving speed lower than 20 km/h (except for stopped) and informs that there is a medium degree of traffic congestion. When the light is flashing quickly, it means that the light is flashing with shorter intervals than when the light is flashing slowly.

The information pattern with the light flashing slowly corresponds to a detection result of the road condition having a driving speed equal to or higher than 20 km/h and lower than 80 km/h and informs that there is a low degree of traffic congestion. The information pattern with the light off corresponds to a detection result of the road condition having a driving speed equal to or higher than 80 km/h and informs that there is no traffic congestion.

The "code" is a 16-digit number that expresses a road condition and can be divided into sections of 3 digits, 2 digits, 8 digits, and 3 digits from the left. The first three digits ("001" in the example in the figure) stand for a number (for example, Route 1) used for identifying the freeway.

The next two digits ("10" in the example in the figure) stand for one of "up lane" and "down lane" ("up lane": 10; "down lane": 20). The next eight digits ("01258500" in the example in the figure) correspond to the detection position of the road condition and stands for the kilometer post (125.85 km). The last three digits stand for the driving speed of vehicles ("000" in the example in the figure because the vehicles are stopped [=0 km/h]). When no vehicles have been detected yet the last three digits will be "999".

Each of the other road-condition informing apparatuses $\mathbf{60}_2$ to $\mathbf{60}_6$ has the same configuration as the road-condition informing apparatus $\mathbf{60}_1$ and includes a corresponding one of sensors $\mathbf{61}_2$ to $\mathbf{61}_6$, a corresponding one of the road-condition informing lights $\mathbf{62}_2$ to $\mathbf{62}_6$, and a corresponding one of control communication units $\mathbf{63}_2$ to $\mathbf{63}_6$.

Each of the sensors $\mathbf{61}_2$ to $\mathbf{61}_6$ has the same configuration as the sensor $\mathbf{61}_1$ and is a sensor that detects a road condition (i.e. whether there is any vehicle and the speed of the vehicle) on the up-lane road 20 (i.e. in a detection area) positioned immediately underneath.

Each of the road-condition informing lights $\mathbf{62}_2$ to $\mathbf{62}_6$ has the same configuration as the road-condition informing light $\mathbf{62}_1$ and is a colored lamp (for example, an orange lamp) that is attached to a corresponding one of the tip portions of the streetlight poles $\mathbf{40}_2$ to $\mathbf{40}_6$. Each of the road-condition informing lights $\mathbf{62}_2$ to $\mathbf{62}_6$ also has the function of informing the drivers of the vehicles of the road condition (whether there is traffic congestion and the degree of the traffic congestion) via light (turning on the light, turning off the light, flashing the light, etc.).

Each of the control communication units $\mathbf{63}_2$ to $\mathbf{63}_6$ has the same configuration as the control communication unit $\mathbf{63}_1$ and controls and drives a corresponding one of the road-condition informing lights $\mathbf{62}_2$ to $\mathbf{62}_6$ according to the road condition, based on a detection result from a corresponding one of the sensors $61_2$ to $61_6$. Each of the control communication units $63_2$ to $63_6$ also transmits a corresponding one of the pieces of road-condition information D$60_2$ to D$60_6$ to each of the navigation apparatuses (e.g. the navigation apparatus 90 shown in FIG. 3) installed on the vehicles, at intervals having a predetermined length.

Like the road-condition information D$60_1$, each of the pieces of road-condition information D$60_2$ to D$60_6$ includes information regarding "detection position", "vehicles", "information pattern", and "code".

On the other hand, on the down-lane road 30 side, the road-condition informing apparatuses $70_1$ to $70_6$ are installed on the tip portions of the streetlight poles $50_1$ to $50_6$, respectively. After detecting the condition of the down-lane road 30 (for example, whether there is traffic congestion and the degree of the traffic congestion), each of the road-condition informing apparatuses $70_1$ to $70_6$ informs the drivers of the vehicles of the condition via light or wireless communication.

Each of the road-condition informing apparatuses $70_1$ to $70_6$ has the same configuration as the road-condition informing apparatus $60_1$ and includes a corresponding one of sensors $71_1$ to $71_6$, a corresponding one of road-condition informing lights $72_1$ to $72_6$, and a corresponding one of control communication units $73_1$ to $73_6$.

Each of the sensors $71_1$ to $71_6$ has the same configuration as the sensor $61_1$ and is a sensor that detects a road condition (i.e. whether there is any vehicle and the speed of the vehicle) on the down-lane road 30 (i.e. in a detection area) positioned immediately underneath.

Each of the road-condition informing lights $72_1$ to $72_6$ has the same configuration as the road-condition informing light $62_1$ and is a colored lamp (for example, an orange lamp) that is attached to a corresponding one of the tip portions of the streetlight poles $50_1$ to $50_6$. Each of the road-condition informing lights $72_1$ to $72_6$ also has the function of informing the drivers of the vehicles of the road condition (whether there is traffic congestion and the degree of the traffic congestion) via light (turning on the light, turning off the light, flashing the light, etc.).

Each of the control communication units $73_1$ to $73_6$ has the same configuration as the control communication unit $63_1$ and controls and drives a corresponding one of the road-condition informing lights $72_1$ to $72_6$ according to the road condition, based on a detection result from a corresponding one of the sensors $71_1$ to $71_6$. Each of the control communication units $73_1$ to $73_6$ also transmits a corresponding one of the pieces of road-condition information D$70_1$ to D$70_6$ to each of the navigation apparatuses (e.g. the navigation apparatus 90 shown in FIG. 3) installed on the vehicles, at intervals having a predetermined length.

Like the road-condition information D$60_1$, each of the pieces of road-condition information D$70_1$ to D$70_6$ includes information regarding "detection position", "vehicles", "information pattern", and "code".

The navigation apparatus 90 shown in FIG. 3 includes a receiving unit 91, a control unit 92, a storing-unit 93, a display unit 94, and a speaker 95. The navigation apparatus 90 is installed on each of the vehicles (i.e. the vehicles $80_1$, $80_2$, and so on and the vehicles $90_1$, $90_2$, and so on) driving on the freeway 10.

The navigation apparatus 90 is an apparatus that displays the position of the vehicle in a real-time manner on a map displayed on the display unit 94, based on a positioning result obtained by a well-known Global Positioning System (GPS), and guides the vehicle to a destination.

Figure 4:
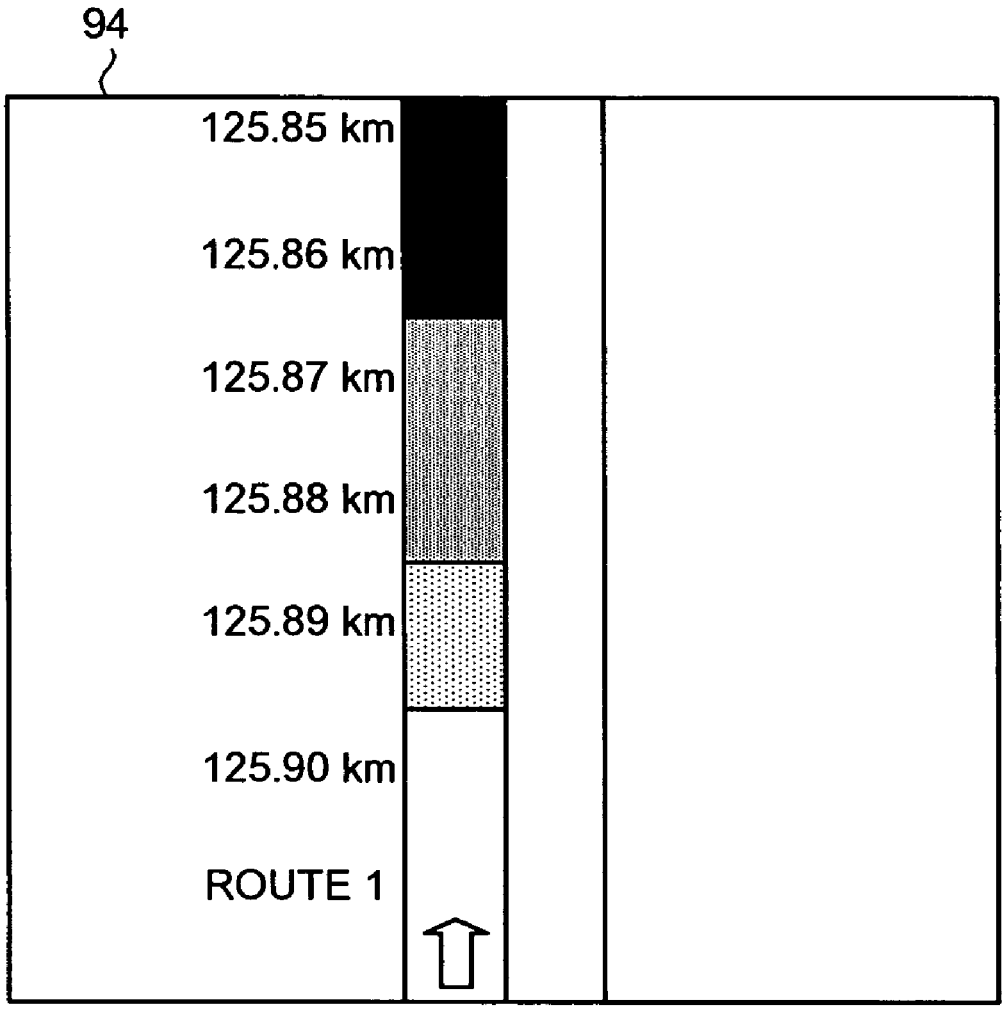
FIG. 4 is a schematic diagram of an example of a road condition display on a display unit 94 shown in FIG. 3.

The navigation apparatus 90 also has a function of receiving the pieces of road-condition information D$60_1$ to D$60_6$ and the pieces of road-condition information D$70_1$ to D$70_6$ from the road-condition informing apparatuses $60_1$ to $60_6$ and the road-condition informing apparatuses $70_1$ to $70_6$, respectively and displaying the road conditions (i.e. traffic congestion conditions) on the display unit 94, as shown in FIG. 4.

The receiving unit 91 has a function of receiving a signal for the GPS, the pieces of road-condition information D$60_1$ to D$60_6$ and the pieces of road-condition information D$70_1$ to D$70_6$. The control unit 92 exercises various types of control related to guiding the vehicle and control for displaying the road conditions. The storing unit 93 stores therein information including road map information. The display unit 94 is provided near the driver of the vehicle and has a function of displaying the road conditions, in addition to guidance information such as a road map and a destination. The speaker 95 has a function of providing audio announcements about driving instructions, traffic congestion conditions, and the like.

Figure 5:
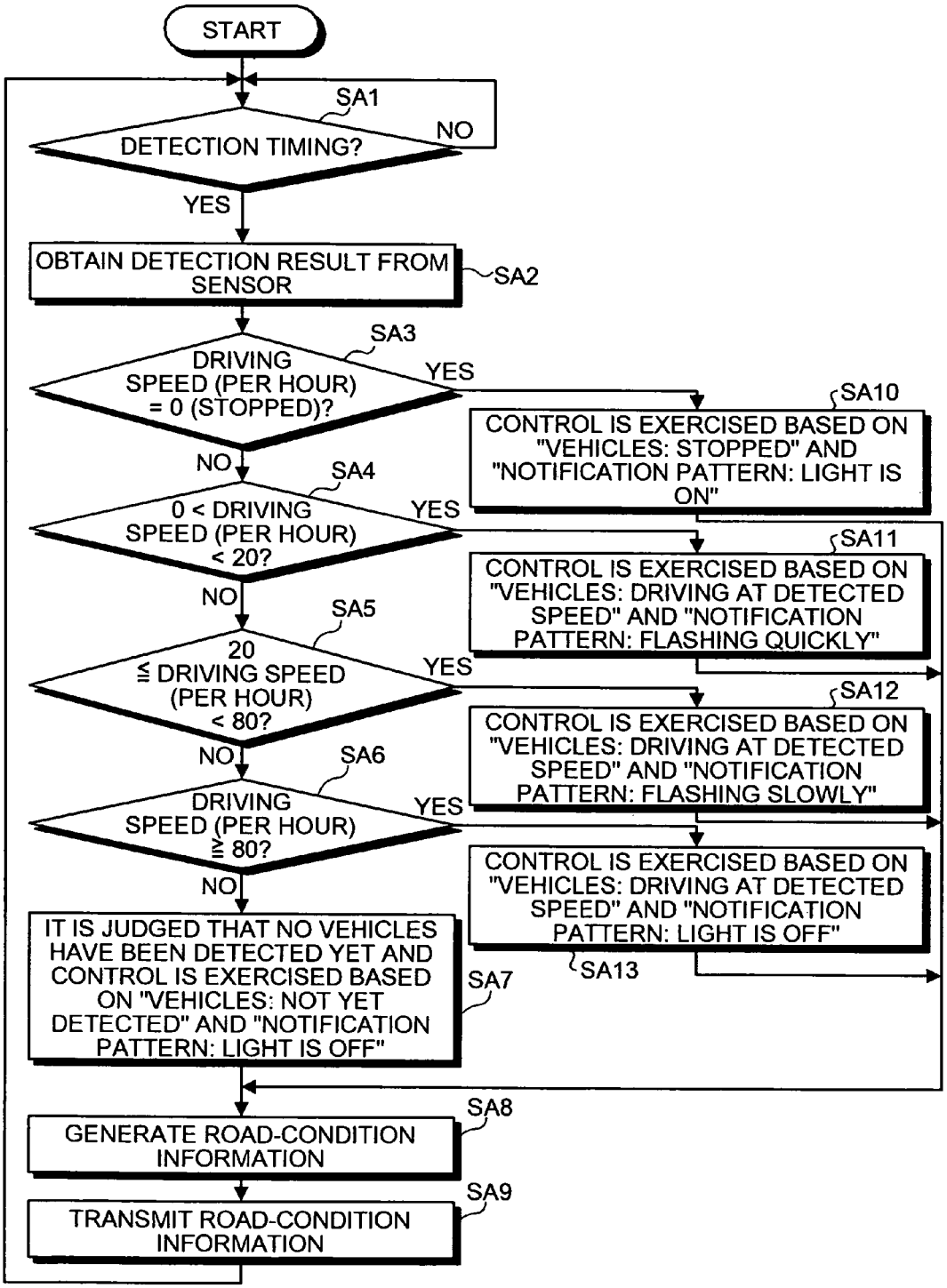
FIG. 5 is a flowchart of an operation performed by each of the road-condition informing apparatuses $\mathbf{60}_1$ to $\mathbf{60}_6$ and the road-condition informing apparatuses $\mathbf{70}_1$ to $\mathbf{70}_6$ shown in FIG. 1.

Next, the operation according to the exemplary embodiment-will be explained, with reference to a flowchart shown in FIG. 5. Under the road conditions (e.g. the degree of traffic congestion) of the up-lane road 20 as shown in FIG. 1, the control communication unit $63_1$ included in the road-condition informing apparatus $60_1$ (see FIG. 3) judges whether now is the time for detection that has been specified in advance (at intervals of a predetermined length). In the present example, the control communication unit $63_1$ obtains a judging result of "No", and repeatedly makes judgments.

When the time of detection has come, the control communication unit $63_1$ obtains a judgment result of "Yes" at step SA1. At step SA2, the control communication unit $63_1$ obtains a detection result of the condition of the road positioned immediately underneath, from the sensor $61_1$. In the present example, the detection result from the sensor $61_1$ shows that the driving speed of the vehicle $80_1$ and the vehicle 802 is 0 km/h (i.e. the vehicles are stopped) because of a high degree of traffic congestion.

At step SA3, the control communication unit $63_1$ judges whether the driving speed (per hour) is "0", based on the detection result from the sensor $61_1$. In the present example, the control communication unit $63_1$ obtains a judgment result of "Yes". At step SA10, the control communication unit $63_1$ judges that there is a high degree of traffic congestion and exercises control so that the road-condition informing light $62_1$ is on, based on "vehicles: stopped" and "information pattern: the light is on". As a result, the road-condition informing light $62_1$ is on. At step SA8, the control communication unit $63_1$ generates road-condition information D$60_1$, based on the detection result from the sensor $61_1$. After transmitting the road-condition information D$60_1$ at step SA9, the control communication unit $63_1$ makes a judgment at step SA1.

Also, the control communication unit $63_2$ included in the road-condition informing apparatus $60_2$ judges, at step SA1, whether now is the time for detection that has been specified in advance (at intervals of a predetermined length). In the present example, the control communication unit $63_2$ obtains a judging result of "No", and repeatedly makes judgments.

When the time of detection has come, the control communication unit $63_2$ obtains a judgment result of "Yes" at step SA1. At step SA2, the control communication unit $63_2$ obtains a detection result of the condition of the road positioned immediately underneath, from the sensor $61_2$. In the present example, the detection result from the sensor $61_2$ shows that the driving speed of the vehicles positioned immediately underneath is 0 km/h (i.e. the vehicles are stopped) because of a high degree of traffic congestion.

At step SA3, the control communication unit $\mathbf{63}_2$ judges whether the driving speed (per hour) is "0", based on the detection result from the sensor $\mathbf{61}_2$. In the present example, the control communication unit 632 obtains a judgment result of "Yes". At step SA10, the control communication unit $\mathbf{63}_2$ judges that there is a high degree of traffic congestion and exercises control so that the road-condition informing light $\mathbf{62}_2$ is on, based on "vehicles: stopped" and "information pattern: the light is on". As a result, the road-condition informing light $\mathbf{62}_2$ is on. At step SA8, the control communication unit 632 generates road-condition information D602, based on the detection result from the sensor 612. After transmitting the road-condition information D602 at step SA9, the control communication unit 632 makes a judgment at step SA1.

Also, the control communication unit $\mathbf{63}_3$ included in the road-condition informing apparatus $\mathbf{60}_3$ judges, at step SA1, whether now is the time for detection that has been specified in advance (at intervals of a predetermined length). In the present example, the control communication unit $\mathbf{63}_3$ obtains a judging result of "No", and repeatedly makes judgments.

When the time of detection has come, the control communication unit $\mathbf{63}_3$ obtains a judgment result of "Yes" at step SA1. At step SA2, the control communication unit $\mathbf{63}_3$ obtains a detection result of the condition of the road positioned immediately underneath, from the sensor $\mathbf{61}_3$. In the present example, the detection result from the sensor $\mathbf{61}_3$ shows that the driving speed of the vehicles positioned immediately underneath is 10 km/h because of a medium degree of traffic congestion.

At step SA3, the control communication unit $\mathbf{63}_3$ judges whether the driving speed (per hour) is "0", based on the detection result from the sensor $\mathbf{61}_3$. In the present example, the control communication unit 633 obtains a judgment result of "No". At step SA4, the control communication unit $\mathbf{63}_3$ judges whether the driving speed (per hour) is higher than "0" and lower than "20", based on the detection result from the sensor $\mathbf{61}_3$. In the present example, the control communication unit $\mathbf{63}_3$ obtains a judgment result of "Yes".

At step SA11, the control communication unit $\mathbf{63}_3$ judges that there is a medium degree of traffic congestion and exercises control so that the road-condition informing light $\mathbf{62}_3$ flashes quickly, based on "vehicles: driving at 10 km/h" and "information pattern: flashing quickly". As a result, the road-condition informing light $\mathbf{62}_3$ flashes quickly. At step SA8, the control communication unit $\mathbf{63}_3$ generates road-condition information D603, based on the detection result from the sensor $\mathbf{61}_3$. After transmitting the road-condition information D603 at step SA9, the control communication unit $\mathbf{63}_3$ makes a judgment at step SA1.

Also, the control communication unit $\mathbf{63}_4$ included in the road-condition informing apparatus $\mathbf{60}_4$ judges, at step SA1, whether now is the time for detection that has been specified in advance (at intervals of a predetermined length). In the present example, the control communication unit $\mathbf{63}_4$ obtains a judging result of "No", and repeatedly makes judgments.

When the time of detection has come, the control communication unit $\mathbf{63}_4$ obtains a judgment result of "Yes" at step SA1. At step SA2, the control communication unit $\mathbf{63}_4$ obtains a detection result of the condition of the road positioned immediately underneath, from the sensor $\mathbf{61}_4$. In the present example, the detection result from the sensor $\mathbf{61}_4$ shows that the driving speed of the vehicles positioned immediately underneath is 15 km/h because of a medium degree of traffic congestion.

At step SA3, the control communication unit $\mathbf{63}_4$ judges whether the driving speed (per hour) is "0", based on the detection result from the sensor $\mathbf{61}_4$. In the present example, the control communication unit $\mathbf{63}_4$ obtains a judgment result of "No". At step SA4, the control communication unit $\mathbf{63}_4$ judges whether the driving speed (per hour) is higher than "0" and lower than "20", based on the detection result from the sensor $\mathbf{61}_4$. In the present example, the control communication unit $\mathbf{63}_4$ obtains a judgment result of "Yes".

At step SA11, the control communication unit $\mathbf{63}_4$ judges that there is a medium degree of traffic congestion and exercises control so that the road-condition informing light $\mathbf{62}_4$ flashes quickly, based on "vehicles: driving at 15 km/h" and "information pattern: flashing quickly". As a result, the road-condition informing light $\mathbf{62}_4$ flashes quickly. At step SA8, the control communication unit 634 generates road-condition information D604, based on the detection result from the sensor 614. After transmitting the road-condition information D604 at step SA9, the control communication unit 634 makes a judgment at step SA1.

Also, the control communication unit $\mathbf{63}_5$ included in the road-condition informing apparatus $\mathbf{60}_5$ judges, at step SA1, whether now is the time for detection that has been specified in advance (at intervals of a predetermined length). In the present example, the control communication unit $\mathbf{63}_5$ obtains a judging result of "No", and repeatedly makes judgments.

When the time of detection has come, the control communication unit $\mathbf{63}_5$ obtains a judgment result of "Yes" at step SA1. At step SA2, the control communication unit $\mathbf{63}_5$ obtains a detection result of the condition of the road positioned immediately underneath, from the sensor $\mathbf{61}_5$. In the present example, the detection result from the sensor $\mathbf{61}_5$ shows that the driving speed of the vehicles positioned immediately underneath is 50 km/h because of a low degree of traffic congestion.

At step SA3, the control communication unit $\mathbf{63}_5$ judges whether the driving speed (per hour) is "0", based on the detection result from the sensor $\mathbf{61}_5$. In the present example, the control communication unit $\mathbf{63}_5$ obtains a judgment result of "No". At step SA4, the control communication unit $\mathbf{63}_5$ judges whether the driving speed (per hour) is higher than "0" and lower than "20", based on the detection result from the sensor $\mathbf{61}_5$. In the present example, the control communication unit $\mathbf{63}_5$ obtains a judgment result of "No".

At step SA5, the control communication unit $\mathbf{63}_5$ judges whether the driving speed (per hour) is equal to or higher than "20" and lower than "80", based on the detection result from the sensor $\mathbf{61}_5$. In the present example, the control communication unit $\mathbf{63}_5$ obtains a judgment result of "Yes".

At step SA12, the control communication unit $\mathbf{63}_5$ judges that there is a low degree of traffic congestion and exercises control so that the road-condition informing light $\mathbf{62}_5$ flashes slowly, based on "vehicles: driving at 50 km/h" and "information pattern: flashing slowly". As a result, the road-condition informing light $\mathbf{62}_5$ flashes slowly. At step SA8, the control communication unit $\mathbf{63}_5$ generates road-condition information D605, based on the detection result from the sensor $\mathbf{61}_5$. After transmitting the road-condition information D605 at step SA9, the control communication unit 635 makes a judgment at step SA1.

Also, the control communication unit $\mathbf{63}_6$ included in the road-condition informing apparatus $\mathbf{60}_6$ judges, at step SA1, whether now is the time for detection that has been specified in advance (at intervals of a predetermined length). In the present example, the control communication unit $\mathbf{63}_6$ obtains a judging result of "No", and repeatedly makes judgments.

When the time of detection has come, the control communication unit $63_6$ obtains a judgment result of "Yes" at step SA1. At step SA2, the control communication unit $63_6$ obtains a detection result of the condition of the road positioned immediately underneath, from the sensor $61_6$. In the present example, the detection result from the sensor $61_6$ shows that the driving speed of the vehicles positioned immediately underneath is 90 km/h because there is no traffic congestion.

At step SA3, the control communication unit $63_6$ judges whether the driving speed (per hour) is "0", based on the detection result from the sensor $61_6$. In the present example, the control communication unit 636 obtains a judgment result of "No". At step SA4, the control communication unit $63_6$ judges whether the driving speed (per hour) is higher than "0" and lower than "20", based on the detection result from the sensor $61_6$. In the present example, the control communication unit $63_6$ obtains a judgment result of "No".

At step SA5, the control communication unit $63_6$ judges whether the driving speed (per hour) is equal to or higher than "20" and lower than "80", based on the detection result from the sensor $61_6$. In the present example, the control communication unit $63_6$ obtains a judgment result of "No".

At step SA6, the control communication unit $63_6$ judges whether the driving speed (per hour) is equal to or higher than "80", based on the detection result from the sensor $61_6$. In the present example, the control communication unit $63_6$ obtains a judgment result of "Yes".

At step SA13, the control communication unit $63_6$ judges that there is no traffic congestion and exercises control so that the road-condition informing light $62_6$ is off, based on "vehicles: driving at 90 km/h" and "information pattern: the light is off". As a result, the road-condition informing light $62_6$ is off. At step SA8, the control communication unit $63_6$ generates road-condition information $60_6$, based on the detection result from the sensor 616. After transmitting the road-condition information $60_6$ at step SA9, the control communication unit $63_6$ makes a judgment at step SA1.

On the other hand, under the road conditions (e.g. the degree of traffic congestion) of the down-lane road 30, the control communication unit $73_1$ included in the road-condition informing apparatus $70_1$ judges, at step SA1, whether now is the time for detection that has been specified in advance (at intervals of a predetermined length). In the present example, the control communication unit $73_1$ obtains a judging result of "No", and repeatedly makes judgments.

When the time of detection has come, the control communication unit $73_1$ obtains a judgment result of "Yes" at step SA1. At step SA2, the control communication unit $73_1$ obtains a detection result of the condition of the road positioned immediately underneath, from the sensor $71_1$. In the present example, the detection result from the sensor $71_1$ shows that the driving speed of the vehicles positioned immediately underneath is 108 km/h because there is no traffic congestion.

At step SA3, the control communication unit $73_1$ judges whether the driving speed (per hour) is "0", based on the detection result from the sensor $71_1$. In the present example, the control communication unit $73_1$ obtains a judgment result of "No". At step SA4, the control communication unit $73_1$ judges whether the driving speed (per hour) is higher than "0" and lower than "20", based on the detection result from the sensor $71_1$. In the present example, the control communication unit $73_1$ obtains a judgment result of "No".

At step SA5, the control communication unit $73_1$ judges whether the driving speed (per hour) is equal to or higher than "20" and lower than "80", based on the detection result from the sensor $71_1$. In the present example, the control communication unit $73_1$ obtains a judgment result of "No".

At step SA6, the control communication unit $73_1$ judges whether the driving speed (per hour) is equal to or higher than "80", based on the detection result from the sensor $71_1$. In the present example, the control communication unit $73_1$ obtains a judgment result of "Yes".

At step SA13, the control communication unit $73_1$ judges that there is no traffic congestion and exercises control so that the road-condition informing light $72_1$ is off, based on "vehicles: driving at 108 km/h" and "information pattern: the light is off". As a result, the road-condition informing light $72_1$ is off. At step SA8, the control communication unit $73_1$ generates road-condition information $D70_1$, based on the detection result from the sensor $71_1$. After transmitting the road-condition information $D70_1$ at step SA9, the control communication unit $73_1$ makes a judgment at step SA1.

Also, the control communication unit $73_2$ included in the road-condition informing apparatus $70_2$ judges, at step SA1, whether now is the time for detection that has been specified in advance (at intervals of a predetermined length). In the present example, the control communication unit $73_2$ obtains a judging result of "No", and repeatedly makes judgments.

When the time of detection has come, the control communication unit $73_2$ obtains a judgment result of "Yes" at step SA1. At step SA2, the control communication unit $73_2$ obtains a detection result of the condition of the road positioned immediately underneath, from the sensor $71_2$. In the present example, the detection result from the sensor $71_2$ shows that no vehicles have been detected yet because there are no vehicles positioned directly underneath.

At step SA3, the control communication unit $73_2$ judges whether the driving speed (per hour) is "0", based on the detection result from the sensor $71_2$. In the present example, the control communication unit $73_2$ obtains a judgment result of "No". At step SA4, the control communication unit $73_2$ judges whether the driving speed (per hour) is higher than "0" and lower than "20", based on the detection result from the sensor 712. In the present example, the control communication unit $73_2$ obtains a judgment result of "No".

At step SA5, the control communication unit $73_2$ judges whether the driving speed (per hour) is equal to or higher than "20" and lower than "80", based on the detection result from the sensor 712. In the present example, the control communication unit 732 obtains a judgment result of "No".

At step SA6, the control communication unit $73_2$ judges whether the driving speed (per hour) is equal to or higher than "80", based on the detection result from the sensor $71_2$. In the present example, the control communication unit $73_2$ obtains a judgment result of "No".

At step SA7, the control communication unit $73_2$ judges that no vehicles have been detected yet (which has the same meaning as no traffic congestion) and exercises control so that the road-condition informing light $72_2$ is off, based on "vehicles: not yet detected" and "information pattern: the light is off". As a result, the road-condition informing light $72_2$ is off. At step SA8, the control communication unit $73_2$ generates road-condition information D702, based on the detection result from the sensor 712. After transmitting the road-condition information D702 at step SA9, the control communication unit $73_2$ makes a judgment at step SA1.

In the same manner as described above, also in the road-condition informing apparatuses $70_3$ to $70_6$, the road condition is detected by each of the sensors $71_3$ to $71_6$, each of the road-condition informing lights $72_3$ to $72_6$ is controlled, and each of the pieces of road-condition information $D70_3$ to $D70_6$ is generated and transmitted.

As a result of the control exercised as described above, on the up-lane road 20, road-condition informing lights $\mathbf{62}_1$, $\mathbf{62}_2$, $\mathbf{62}_3$, $\mathbf{62}_4$, $\mathbf{62}_5$, and $\mathbf{62}_6$ are, respectively, on, flashing quickly, flashing quickly, flashing slowly, and off, according to the road conditions (i.e. the degrees of the congestion). With these arrangements, the drivers of the vehicles on the freeway 10 are able to visually recognize the road conditions ahead in a real-time and appropriate manner.

On the other hand, on the down-lane road 30, because there is no traffic congestion, all of the road-condition informing lights $\mathbf{72}_1$ to $\mathbf{72}_6$ are off.

The pieces of road-condition information D$\mathbf{60}_1$ to D$\mathbf{60}_6$ and the pieces of road-condition information D$\mathbf{70}_1$ to D$\mathbf{70}_6$ are transmitted from the road-condition informing apparatuses $\mathbf{60}_1$ to $\mathbf{60}_6$ and the road-condition informing apparatuses $\mathbf{70}_1$ to $\mathbf{70}_6$, respectively, at each time of detection so that the pieces of road-condition information are not in synchronization with one another.

The pieces of road-condition information D$\mathbf{60}_1$ to D$\mathbf{60}_6$ and the pieces of road-condition information D$\mathbf{70}_1$ to D$\mathbf{70}_6$ are sequentially received by the receiving unit 91 included in the navigation apparatus 90, as shown in FIG. 3, that is installed on each of the vehicles that are positioned, for example, on the down lane side (at the bottom of FIG. 1) of the up-lane road 20.

The control unit 92 included in the navigation apparatus 90 analyzes the pieces of road-condition information D$\mathbf{60}_1$ to D$\mathbf{60}_6$ and the pieces of road-condition information D$\mathbf{70}_1$ to D$\mathbf{70}_6$ and causes the display unit 94 shown in FIG. 4 to display the road conditions being mapped on a road map. In FIG. 4, a road map that corresponds to the freeway 10 shown in FIG. 1 and the road conditions (the degrees of the traffic congestion are expressed by, for example, the darkness of the hatched areas) are displayed.

Accordingly, the drivers of the vehicles on each of which the navigation apparatus 90 is installed are able to recognize the road condition ahead in a real-time and appropriate manner, from the display unit 94.

According to another exemplary embodiment, an arrangement is acceptable in which the road conditions ahead are provided by way of an audio announcement from the speaker 95, saying, for example, "on the up-lane road, there is traffic congestion with the traffic stopped at the 125.85 km point", "on the up-lane road, the traffic is moving at 10 km/h, at the 128.87 km point", and "on the up-lane road, the traffic is moving at 90 km/h, at the 125.90 km point".

According to another exemplary embodiment, an arrangement is acceptable, in which the road conditions are displayed on the front windshield glass or on a head-up display, instead of on the display unit 94 shown in FIG. 3.

Further, according to another exemplary embodiment, an arrangement is acceptable in which, when the road-condition informing light should be off (i.e. when no vehicles have been detected yet and when the driving speed is "0"), the road-condition information does not get transmitted.

As explained so far, according to the exemplary embodiment, the light emitting state (i.e. the light is on, flashing quickly, flashing slowly, or off) of the road-condition informing unit $\mathbf{62}_1$ and so on is controlled, based on the detection result regarding the road condition (for example, the traffic congestion condition) near one of the plurality of detection positions on the up-lane road 20 of the freeway 10 so that the drivers of the vehicles driving on the up-lane road 20 of the freeway 10 are informed of the road condition. Thus, it is not necessary to use an integrated control apparatus as an intermediary, unlike in the system according to the conventional technique. Consequently, it is possible to give information of the road conditions at low cost and in a real-time manner.

In the description above, the exemplary embodiment of the present invention has been explained with reference to the drawings. However, specific configuration examples of the present invention are not limited to the exemplary embodiment. Other various embodiments to each of which a design modification or the like has been applied without departing from the gist of the present invention are also considered as a part of the present invention.

Figure 6:
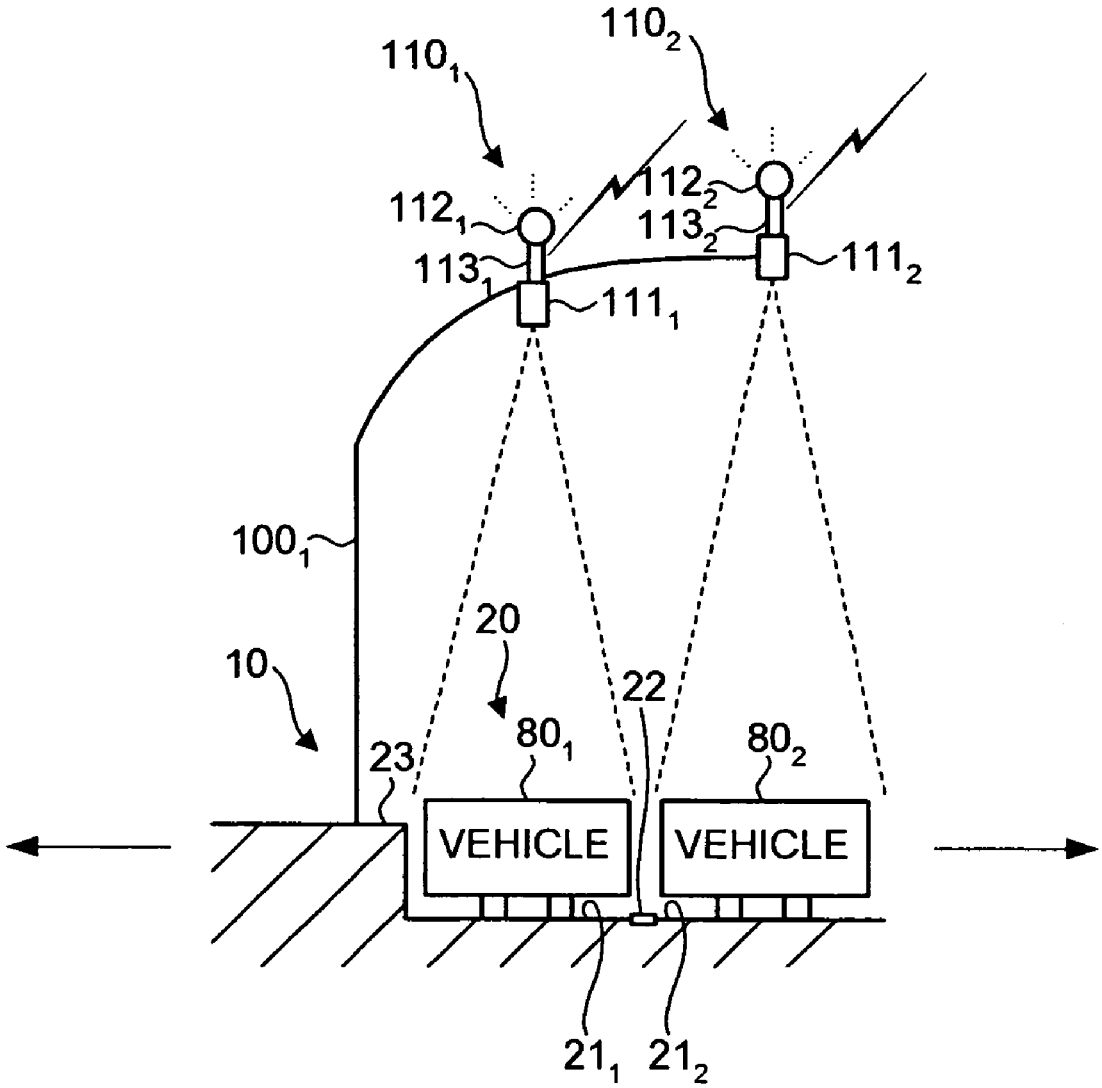
FIG. 6 is a cross-sectional view for explaining a modification example of the present embodiment.

For example, according to another exemplary embodiment, an arrangement is acceptable in which a set of road-condition informing apparatuses are provided for each of the lanes (or for each of types of vehicles), as shown in FIG. 6, so that more detailed information of the road conditions can be given.

In FIG. 6, a pole $\mathbf{100}_1$ is disposed on the shoulder 23 of the up-lane road. On the tip portion of the pole $\mathbf{100}_1$, a first road-condition informing apparatus $\mathbf{110}_1$ and a second road-condition informing apparatus $\mathbf{110}_2$ are installed.

The first road-condition informing apparatus $\mathbf{110}_1$ is an apparatus that, after detecting the condition (for example, whether there is traffic congestion and the degree of the traffic congestion) of the first up lane $\mathbf{21}_1$ of the up-lane road 20, informs drivers of vehicles of the detected condition via light or wireless communication. Like the road-condition informing apparatus $\mathbf{60}_1$ (see FIG. 2), the first road-condition informing apparatus $\mathbf{110}_1$ includes a first sensor $\mathbf{111}_1$, a first road-condition informing light $\mathbf{112}_1$, and a first control communication unit $\mathbf{113}_1$.

The first sensor $\mathbf{111}_1$ is one of an ultrasound sensor, an infrared ray sensor, a wireless beacon, a metal sensor, a camera, and the like that is attached to the upper portion of the pole $\mathbf{100}_1$ and is a sensor that detects the road condition (i.e. whether there is any vehicle and the speed of the vehicle) in the first up lane $\mathbf{21}_1$ positioned immediately underneath.

The first road-condition informing light $\mathbf{112}_1$ is a colored lamp (for example, an orange lamp) that is attached to the upper portion of the pole $\mathbf{100}_1$ and has a function of informing the drivers of the vehicles of the road condition (whether there is traffic congestion and the degree of the traffic congestion) via light (turning on the light, turning off the light, flashing the light, etc.).

The first control communication unit $\mathbf{113}_1$ controls and drives, based on the detection result from the first sensor $\mathbf{111}_1$, the first road-condition informing light $\mathbf{112}_1$ according to the road condition. The first control communication unit $\mathbf{113}_1$ also transmits the road-condition information to each of the navigation apparatuses (not shown) installed on the vehicles, at intervals having a predetermined length.

On the other hand, the second road-condition informing apparatus $\mathbf{110}_2$ is an apparatus that, after detecting the condition (for example, whether there is traffic congestion and the degree of the traffic congestion) of the second up lane $\mathbf{21}_2$ of the up-lane road 20, informs the drivers of the vehicles of the detected condition via light or wireless communication. Like the first road-condition informing apparatus $\mathbf{110}_1$, the second road-condition informing apparatus $\mathbf{110}_2$ includes a second sensor $\mathbf{111}_2$, a second road-condition informing light $\mathbf{112}_2$, and a second control communication unit $\mathbf{113}_2$.

The second sensor $\mathbf{111}_2$ is one of an ultrasound sensor, an infrared ray sensor, a wireless beacon, a metal sensor, a camera, and the like that is attached to the tip portion of the pole $\mathbf{100}_1$ and is a sensor that detects the road condition (i.e. whether there is any vehicle and the speed of the vehicle) in the second up lane $\mathbf{21}_2$ positioned immediately underneath.

The second road-condition informing light $\mathbf{112}_2$ is a colored lamp (for example, an orange lamp) that is attached to the tip portion of the pole $\mathbf{100}_1$ and has a function of informing the drivers of the vehicles of the road condition (whether there is traffic congestion and the degree of the traffic congestion) via light (turning on the light, turning off the light, flashing the light, etc.).

The second control communication unit $\mathbf{113}_2$ controls and drives, based on the detection result from the second sensor $\mathbf{111}_2$, the second road-condition informing light $\mathbf{112}_2$ according to the road condition. The second control communication unit $\mathbf{113}_2$ also transmits the road-condition information to each of the navigation apparatuses (not shown) installed on the vehicles, at intervals having a predetermined length.

In the description of the exemplary embodiment, the example in which the road-condition informing apparatuses are used on a freeway has been explained. However, it is acceptable to use the road-condition informing apparatuses in a tunnel or on a bridge. In such a situation, the plurality of road-condition informing apparatuses may be installed on the ceiling of a tunnel or on the beam of a bridge, with predetermined intervals therebetween.

In the description of the exemplary embodiment, the example has been explained in which the drivers of the vehicles are informed of the road conditions by way of changing the lighting state (i.e. the light is on, flashing quickly, flashing slowly, or off) of the road-condition informing lights $\mathbf{62}_1$ to $\mathbf{62}_6$. However, another arrangement is acceptable in which each of the road-condition informing lights is able to emit light in multiple colors so that the drivers of the vehicles are informed of the road conditions by way of changing the color (or changing the combination of a color and a lighting state).

Further, in the description of the exemplary embodiment, the example has been explained in which the pieces of road-condition information D$\mathbf{60}_1$ to D$\mathbf{60}_6$ and the like that correspond to the road conditions are transmitted to the vehicles. However, another arrangement is acceptable, in which the pieces of road-condition information D$\mathbf{60}_1$ to D$\mathbf{60}_6$ and the like are transmitted to an integrated control apparatus via wired communication, wireless communication, or the like.

Furthermore, it is acceptable to arrange the exemplary embodiment so that when a result of an analysis of the received pieces of road-condition information D$\mathbf{60}_1$ to D$\mathbf{60}_6$ and the like performed by the control unit 92 included in the navigation apparatus (see FIG. 3) shows that there is congestion ahead at a close location, the vehicle is controlled and automatically braked so that the speed is reduced.

In addition, in the description of the exemplary embodiment, the example has been explained in detail in which the information related to traffic congestion is used as an example of the road-condition information. However, the road-condition information may be any other types of information as long as the information is useful information that should be provided for drivers of vehicles to help them drive safely. For example, the road-condition information may include the following types of information (1) to (5):

(1) congestion condition information as described above;

(2) information regarding the conditions of the road surfaces (cave-ins, landslides, collapses of bridge supports, road surface freezing, and so on);

(3) information regarding weather conditions (rain, fog, thunderstorms, snow, windstorms, earthquakes, and so on);

(4) information regarding the conditions on the roads (traffic accidents, fires, people or animals on the roads, objects fell on the roads and so on); and (5) driving conditions of vehicles (short distance between vehicles, zigzagging on the roads, driving in an opposite direction of the traffic flow, driving while making noise).

As a sensor for detecting the conditions (1) to (5) listed above, it is appropriate to use the following devices (a) to (g), respectively:

(a) meteorological sensors for (3);

(b) cameras (or images) for (1) to (5);

(c) ultrasound sensors and wireless beacons for (1);

(d) vibration sensors, acceleration sensors, and seismometers, for (2) and (3);

(e) fire sensors for (4);

(f) sound sensors (or microphones) for (4) (to detect the sound from passing emergency vehicles and accidents) and (5); and (g) optical sensors (to scan the road surfaces with laser beams) for (1) to (5).

It is acceptable to modify the exemplary embodiment by using a light-emitting-type level gauge instead of the road-condition informing light $\mathbf{62}_1$ and the like, so that a level is displayed according to the congestion condition.

Also, it is acceptable to modify the exemplary embodiment by attaching a light to each of the streetlight poles and displaying, with the light, information according to the congestion conditions (for example, information being expressed by flashing the light or turning on the light) toward the surface of the roads (or preferably toward a white line 22 or a white line 32).

Further, in the description of the exemplary embodiment, the example has been described in which the road-condition informing apparatus $\mathbf{60}_1$ and so on are installed on the streetlight pole $\mathbf{40}_1$ and so on, respectively. However, another arrangement is acceptable in which the road-condition informing apparatus $\mathbf{60}_1$ and so on are installed on objects positioned on the roads such as guardrails or electric poles, instead of on the streetlight pole $\mathbf{40}_1$ and so on.

Further, it is acceptable to modify the exemplary embodiment by giving information of traffic congestion as if there was traffic congestion at a position before the actual location of the traffic congestion, so that there is enough time to address the situation by, for example, reducing the speed of the vehicle before the traffic congestion. With this arrangement, it is possible to achieve an effect where vehicles are prevented from crashing into other vehicles.

Furthermore, it is acceptable to realize the functions according to the exemplary embodiment by having a program recorded onto a computer-readable recording medium and having the program that has been recorded on the recording medium read and executed by a computer, the program being used for realizing the functions of the road-condition informing apparatuses and the navigation apparatus 90.

INDUSTRIAL APPLICABILITY

As explained above, the road-condition informing apparatus and the road-condition informing method according to the present invention are useful in, for example, informing drivers of vehicles of congestion conditions on freeways.

The invention claimed is:

1. An apparatus for informing a road condition of a road to a driver of a vehicle driving on the road, the apparatus comprising:

a detecting unit configured to be provided at a detection position on the road and to detect the road condition near the detection position;

a light emitting unit configured to be provided at the detection position and to emit a light; and a control unit that controls a light emission of the light emitting unit based on detected road condition, wherein the detecting unit is provided in correspondence with a single lane of a road having a plurality of lanes, and wherein the light emitting unit is operative to provide a flashing light with a variable frequency that is controlled on the basis of an output of the detecting unit to represent a respective one of a plurality of road conditions.

2. The apparatus according to claim 1, further comprising:

a transmitting unit that transmits information on the detected road condition to the vehicle driving on the road.

3. The apparatus according to claim 1, wherein the light emitting unit emits the light toward a surface of the road.

4. A system for informing a road condition of a road to a driver of a vehicle driving on the road, the system comprising:

a plurality of road-condition informing apparatuses provided at a plurality of detection positions on the road, wherein each of the road-condition informing apparatuses includes a detecting unit that detects the road condition near corresponding detection position;

a light emitting unit that emits a light; and a control unit that controls a light emission of the light emitting unit based on detected road condition, wherein the detecting unit is provided in correspondence with a single lane of a road having a plurality of lanes, and wherein the light emitting unit is operative to provide a flashing light with a variable frequency that is controlled on the basis of an output of the detecting unit to represent a respective one of a plurality of road conditions.

5. The system according to claim 4, wherein the light emitting unit is positioned above the road, and light emissions of light emitting units of the road-condition informing apparatuses are recognized by the driver of the vehicle driving toward the light emitting units in an ascending order of respective distances from the vehicle.

6. The system according to claim 4 wherein the light emitting unit emits the light toward a surface of the road.

7. The system according to claim 4, wherein each of the road-condition informing apparatuses further includes a transmitting unit that transmits information on the detected road condition to the vehicle driving on the road.

8. The system according to claim 7, wherein the vehicle includes:

a receiving unit that receives the detected road condition from the transmitting unit of each of the road-condition informing apparatuses;

a control unit that analyzes a traffic condition of the road based on received road condition; and a display unit that displays thereon analyzed traffic condition.

9. The system according to claim 7, wherein the vehicle includes a receiving unit that receives the detected road condition from the transmitting unit of each of the road-condition informing apparatuses; and a control unit that analyzes a traffic condition of the road based on received road condition, and controls a speed of the vehicle based on analyzed traffic condition.

10. A method of informing a road condition of a road to a driver of a vehicle driving on the road, the method comprising:

detecting the road condition near a detection position on the road; and controlling a light emission of a light emitting unit provided at the detection position based on detected road condition, wherein the detecting unit is provided in correspondence with a single lane of a road having a plurality of lanes, and wherein the light emitting unit is operative to provide a flashing light with a variable frequency that is controlled on the basis of an output of the detecting unit to represent a respective one of a plurality of road conditions.

* * * * *